US005507619A

United States Patent [19]

Ryan

[11] Patent Number: 5,507,619

[45] Date of Patent: Apr. 16, 1996

[54] WATER RESISTANT CEILING FAN

[75] Inventor: James C. Ryan, Germantown, Tenn.

[73] Assignee: Hunter Fan Company, Memphis, Tenn.

[21] Appl. No.: 524,161

[22] Filed: Aug. 31, 1995

Related U.S. Application Data

[63] Continuation of Ser. No. 209,990, Mar. 10, 1994, abandoned.

[51] Int. Cl.[6] ..... F04D 29/08

[52] U.S. Cl. ..... 416/5; 416/244 R; 277/212 C; 277/212 F

[58] Field of Search ..... 416/5, 170 R, 416/244 R, 246; 248/342–344; 310/40.5, 62, 63; 277/212 R, 212 C, 212 F, 212 FB; 362/96

[56] References Cited

U.S. PATENT DOCUMENTS

| | | | |
|---|---|---|---|
| 1,736,240 | 11/1929 | Wyss | 246/343 |
| 3,512,024 | 5/1970 | Papa | 310/63 |
| 3,676,570 | 7/1972 | Gabb | 248/343 |
| 4,410,160 | 10/1983 | Alperin et al. | 248/342 |
| 4,592,702 | 6/1986 | Bogage | 416/5 |
| 4,878,806 | 11/1989 | Markwardt | 416/5 |
| 5,135,365 | 8/1992 | Bogage | 416/5 |
| 5,154,579 | 10/1992 | Rezek | 416/5 |

FOREIGN PATENT DOCUMENTS

| | | | |
|---|---|---|---|
| 0000212 | of 1911 | United Kingdom | 416/244 R |
| 0706170 | 3/1954 | United Kingdom | 310/62 |

*Primary Examiner*—Edward K. Look
*Assistant Examiner*—Christopher Verdier
*Attorney, Agent, or Firm*—Baker, Donelson, Bearman & Caldwell

[57] ABSTRACT

A water resistant ceiling fan having first and second sealing members for preventing the entry of moisture into both the canopy and the motor housing. The canopy sealing member has a substantially flat top portion which fits flush against the ceiling, and a downwardly depending annular wall which encircles the top portion of the canopy. The motor housing sealing member is disposed intermediate the top portion of the housing and an adapter secured to the lower end of a downrod, the upper end of which is secured to the canopy. The sealing members effectively prevent moisture from entering through the interface between the canopy and the ceiling, and the interface between the adapter and the motor housing.

1 Claim, 2 Drawing Sheets

WATER RESISTANT CEILING FAN

This application is a continuation of U.S. application Ser. No. 08/209,990, filed Mar. 10, 1994, now abandoned.

BACKGROUND OF THE INVENTION

1. Field

This invention relates to ceiling fans and, more particularly, to a ceiling fan having a water resistant canopy and motor housing.

2. Description of the Prior Art

Ceiling fans have, for a number of years, enjoyed widespread acceptance in both residential and commercial settings. The vast majority of such usages have been indoors, since the electric motor and related circuitry of a conventional ceiling fan is not particularly well suited for use outdoors due to their relatively low resistance to the adverse effects of moisture. It has been recognized, however, that it may be desirable to install a ceiling fan on a porch, gazebo, or some other outdoor setting.

The prior art includes certain examples of ceiling fans which have been adapted for outdoor use through the addition of external seals. U.S. Pat. Nos. 4,592,702 issued Jun. 3, 1986 and 5,135,365 issued Aug. 4, 1992 to Bogage disclose similar sealing techniques for use on a ceiling fan having a rotating external motor housing. Neither of these references discloses a water resistant fan having a stationary exterior housing, with an inner rotating member attached to the blades. Additionally, neither reference discloses a manner of preventing moisture from entering through the top of the canopy adjacent the ceiling, a common problem in outdoor settings due to condensation caused by high humidity. Accordingly, a need has been recognized for improvements in the prior art.

BRIEF SUMMARY OF THE INVENTION

An object of this invention is to provide a water resistant ceiling fan suitable for use in most outdoor environments.

Another object is to provide a water resistant ceiling fan having the outward appearance of a conventional contemporary fan motor, with a stationary outer housing and an internal rotating member attached to the fan blades.

In order to achieve these and other objects, the present invention comprises a water resistant ceiling fan having a canopy removably securable to a ceiling, with a top portion and a bottom portion, a housing substantially enclosing a motor, having an opening in a top portion, means for suspending the housing from the canopy, and sealing means disposed intermediate the canopy and the ceiling operative to prevent moisture from entering the top portion of the canopy, the sealing means also being disposed at least partially within the housing, operative to prevent moisture from entering the housing through the opening in its top portion.

Other objects and advantages provided by this invention will become apparent to those skilled in the art upon reading the following detailed description of the preferred embodiment, in conjunction with the appended drawings.

DETAILED DESCRIPTION OF THE PREFERRED EMBODIMENT

Figure 7:
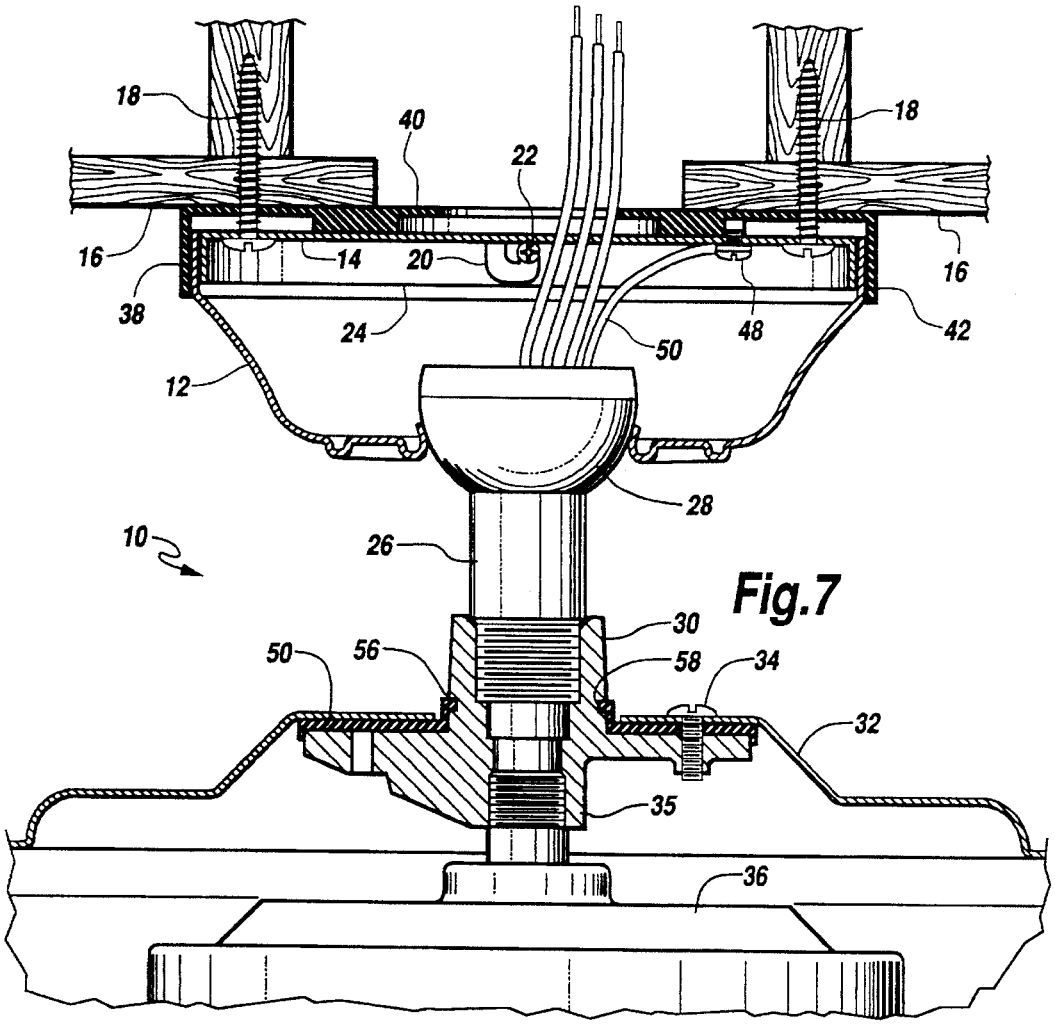
FIG. 7 is a sectional view through the ceiling fan of the present invention, illustrating the placement of the sealing members.

Referring initially to FIG. 7, ceiling fan 10 comprises a canopy 12 removably securable to a mounting plate 14, which is affixed to ceiling 16 by a plurality of screws 18. Canopy 12 has a plurality of J-shaped slots 20 formed in the upper portion thereof for engaging screws 22 extending radially from the annular wall 24 of mounting plate 14. Downrod 26 is pivotally retained within canopy 12, its upper end having a ball 28 secured thereto and its lower end threadingly engaging adapter 30. Housing 32 is secured to adapter 30 by at least one screw 34, and shaft 35 extending from motor 36 threadingly engages the lower portion of adapter 30. A plurality of fan blades (not shown) are preferably secured to the under side of motor 36, and rotate therewith. Those skilled in the art will readily appreciate that the foregoing description applies to generally conventional suspending means found in existing ceiling fans. The unique features of the present invention are described below.

Figure 1:
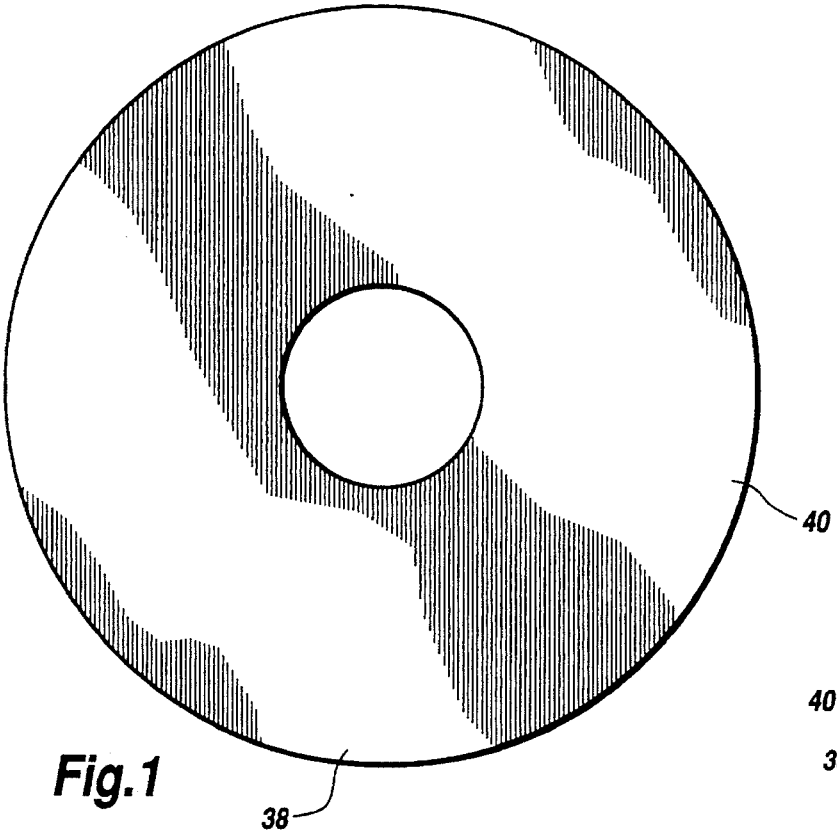
FIG. 1 is a top plan view of the canopy sealing member of the present invention.
Figure 2:
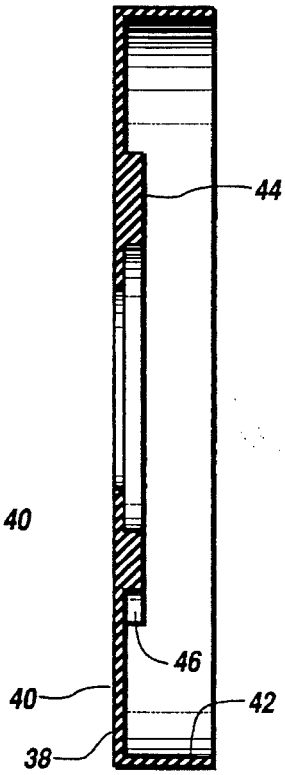
FIG. 2 is a side sectional view through the canopy sealing member, taken along line 2—2 of FIG. 3.
Figure 3:
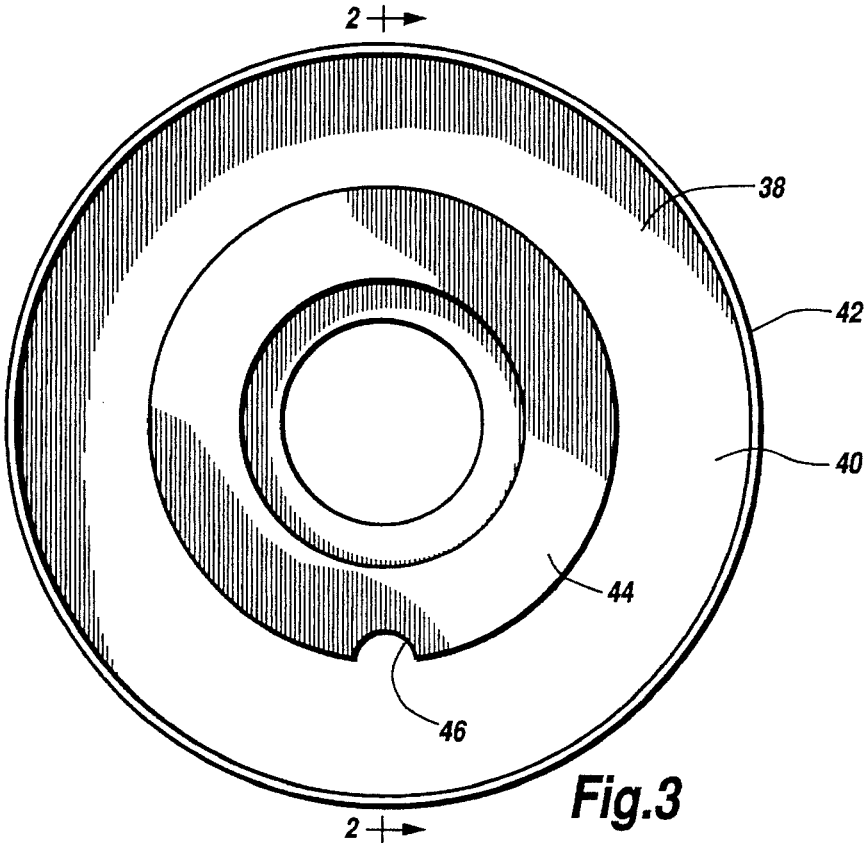
FIG. 3 is a bottom plan view of the canopy sealing member shown in FIG. 1.

In order to prevent moisture from entering canopy 12, ceiling fan 10 includes an upper sealing ring 38 disposed intermediate mounting plate 14 and ceiling 16. Sealing ring 38 is shown in detail in FIGS. 1 through 3. Sealing ring 38 consists of a disk shaped top portion 40 having an integrally formed annular wall 42 extending downwardly therefrom, and is preferably formed from rubber or an elastomeric compound suitable for the purpose.

Sealing ring 38 is secured in place by screws 18, which also serve to retain mounting plate 14 as mentioned above. During installation, screws 18 are inserted through their corresponding holes formed in mounting plate 14, and the pointed leading ends of screws 18 utilized to form holes in the top portion 40 of sealing ring 38. It has been found preferable to utilize screws 18 to puncture top portion 40 in this manner, rather than providing preformed through holes, in order to minimize alignment problems and to ensure an effective seal around the resulting holes. After mounting plate 14 and sealing ring 38 are properly secured to ceiling 16, canopy 12 may be installed as shown in FIG. 7, with annular wall 42 encircling the top portion of canopy 12, thereby effectively sealing the interface between ceiling 16 and canopy 12 to prevent condensation from entering canopy 12 from above.

In the preferred embodiment shown, the inside surface of top portion 40 has an upstanding ridge 44 disposed thereon, with notch 46 formed therein. As seen in FIG. 7, ridge 44 serves as a spacer between mounting plate 14 and top portion 40 to provide clearance for the distal end of screw 48, which is used to attach grounding wire 50 to mounting plate 14. Notch 46 accommodates the distal end of screw 48 to prevent interference with ridge 44.

Figure 4:
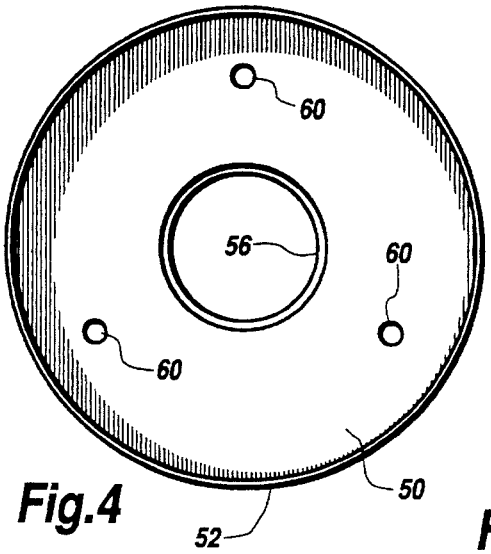
FIG. 4 is a bottom plan view of the motor housing sealing member of the present invention.
Figure 5:
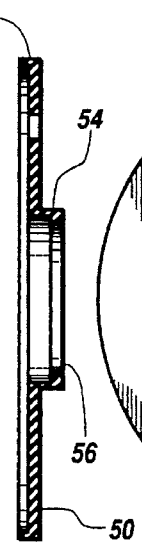
FIG. 5 is a side sectional view of the motor housing sealing member, taken along line 5—5 of FIG. 6.
Figure 6:
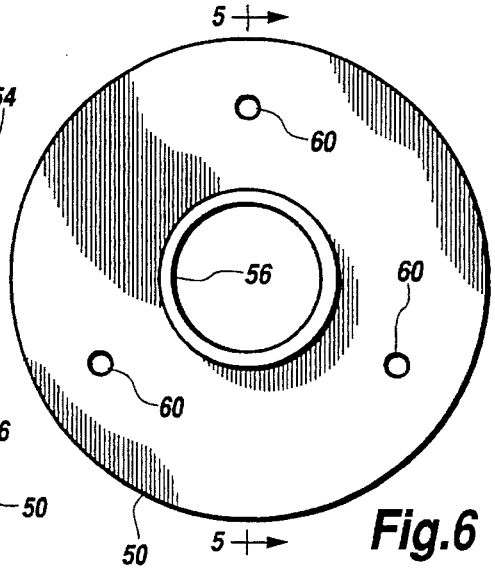
FIG. 6 is a top plan view of the motor housing ceiling member.

Ceiling fan 10 includes a second sealing member 50, disposed intermediate housing 32 and adapter 30 as shown in FIG. 7. As seen in FIGS. 4–6, sealing member 50 is essentially disk shaped, having an annular lip 52 extending downwardly from the underside and a central portion 54 extending upwardly from the topside. Central portion 54 includes an inner shoulder 56, which seats within slot 58 formed in the upper portion of adapter 30 to improve the moistureproof seal formed therebetween. Ceiling member 50 may include a plurality of holes 60 formed therein for providing suitable passageways for screws 34, and is preferably formed from rubber.

As evidenced by this disclosure, in conjunction with the appended drawings, the principles of a ceiling fan having sealing means for preventing moisture from entering either the top portion of the canopy or the top of the motor housing have been made clear. It is to be expected, however, that numerous modifications may be made in the preferred embodiment disclosed herein without departing from the spirit and scope of this invention. Accordingly, the scope of coverage provided by this patent is to be limited only by the following claims and prior art.

What is claimed is:

1. A water resistant ceiling fan, comprising:

a mounting plate rigidly securable to a ceiling;

a canopy removably securable to said mounting plate, having an upper edge portion and a bottom portion;

a disk shaped elastomeric cover having an integrally formed annular wall extending downwardly therefrom disposed intermediate said mounting plate and said ceiling and encircling said upper edge portion of said canopy, operative to prevent moisture from entering said top portion of said canopy;

a housing, substantially enclosing a motor, having an opening in a top portion thereof;

an adapter at least partially disposed within said housing having an upper portion extending upwardly through said opening in said housing, said upper portion having an annular slot formed thereon;

means for suspending said housing from said canopy comprising a down rod having a first end pivotally engageable within said bottom portion of said canopy, and a second end secured to said upper portion of said adapter; and a disk shaped rubber member disposed at least partially within said housing and sealingly engaging at least a portion of said adapter, operative to prevent moisture from entering said housing through said opening, said rubber member including a central portion extending upwardly therefrom for sealingly engaging said upper portion of said adapter, said central portion including an inner shoulder which seats within said annular slot on said upper portion of said adapter operative to further prevent moisture from entering said housing through said opening.

* * * * *